US005242079A

United States Patent [19]

Stephens et al.

[11] Patent Number: 5,242,079

[45] Date of Patent: Sep. 7, 1993

[54] SEALABLE COVER FOR AN OPEN BEVERAGE CONTAINER

[75] Inventors: Ruth A. Stephens, Norton, Ohio; Giovanni Pino, Grand Rapids, Mich.

[73] Assignee: Three Co., Norton, Ohio

[21] Appl. No.: 943,723

[22] Filed: Sep. 11, 1992

[51] Int. Cl.[5] ..... A47G 19/22

[52] U.S. Cl. ..... 220/705; 220/338; 220/708; 220/709; 220/367; 220/373; 215/229; 222/484; 222/536; 222/570

[58] Field of Search ..... 215/1 A, 229, 235, 237; 220/705, 707, 708, 709, 710, 338, 367, 373; 222/211, 464, 482, 484, 526, 528, 530, 531, 534, 536, 538, 556, 570

[56] References Cited

U.S. PATENT DOCUMENTS

| | | | |
|---|---|---|---|
| 2,314,167 | 3/1943 | Shaw . | |
| 2,778,537 | 1/1957 | Kanno . | |
| 3,163,337 | 12/1964 | Wilson . | |
| 3,655,099 | 4/1972 | Hazard . | |
| 3,718,238 | 2/1973 | Hazard et al. . | |
| 3,863,818 | 2/1975 | Hazard . | |
| 3,874,562 | 4/1975 | Hazard . | |
| 3,907,179 | 9/1975 | Pehr . | |
| 4,164,305 | 8/1979 | Haggerty . | |
| 4,219,138 | 8/1980 | Hazard . | |
| 4,271,984 | 6/1981 | Ducros . | |
| 4,291,814 | 9/1981 | Conn . | |
| 4,485,963 | 12/1984 | Panicci | 215/229 X |
| 4,487,342 | 12/1984 | Shy . | |
| 4,503,991 | 3/1985 | Joyce . | |
| 4,596,341 | 6/1986 | Bruffey . | |
| 4,674,661 | 6/1987 | Herold . | |
| 4,732,303 | 3/1988 | Wang . | |
| 4,782,985 | 11/1988 | Kinsley . | |
| 4,881,668 | 11/1989 | Kitterman et al. . | |
| 4,887,747 | 12/1989 | Ostrowsky et al. . | |
| 5,065,881 | 11/1991 | Tarng | 220/258 |
| 5,065,909 | 11/1991 | Pino . | |

FOREIGN PATENT DOCUMENTS

| | | |
|---|---|---|
| 1051748 | 12/1966 | United Kingdom . |

*Primary Examiner*—Allan N. Shoap
*Assistant Examiner*—Nova Stucker
*Attorney, Agent, or Firm*—Waters & Morse

[57] ABSTRACT

This cover for an opened beverage container has a pivoted valve in the withdrawal passage that is opened and closed according to the position of a tubular spout integral with the valve. The valve is supported by journals engaging bearings, and having a conical sealing portion. The spout has a ball-ended vent plug engageable with a vent opening in the cover, with the opening having a snap-in section and a dissociated more relaxed sealing section that continues to grip the ball end gently after repeated uses of the snap-in function.

4 Claims, 2 Drawing Sheets

SEALABLE COVER FOR AN OPEN BEVERAGE CONTAINER

BACKGROUND OF THE INVENTION

Several attempts have been made to provide a sealable cover for an open beverage container. The best of these have a pivoted spout through which the contents of the container can be withdrawn. Movement of the spout through a sector of around ninety degrees or less, controls a valve in the withdrawal passage to open or shut off the flow. Venting the interior of the container is also opened or closed as a function of the position of the spout. As a practical matter, these devices must be capable of being molded of standard plastic materials, and with a minimum number of parts, and also with a simple assembly procedure.

These devices have gone through a significant evolution in design, an earlier form of the device being shown in U.S. Pat. No. 5,065,909. These devices have shown that there are a couple of persistent problems associated with previous designs. One is the necessity to open the vent before the valve in the withdrawal passage is opened, in order to release the gas pressure from carbonated beverages before it can squirt out liquid through the spout, to the consternation of anyone in the immediate vicinity. The other problem is the maintenance of an adequate seal at all points along paths leading from the interior of the container to the exterior of the device in order to prevent leakage when the unit is fully closed. One of the promising forms of the device provides a vent opening in the top surface of the cover at a point remote from the pivoted valve. In the closed position of the valve, a plug on the spout enters the vent opening, and supposedly closes it. A ball-ended plug can provide a snap-in feature retaining the closed position of the spout. Experience with this construction has established that forcing the ball into the vent opening, and then on through it, tends eventually to enlarge the opening to the point that a full seal is lost The material of the cover does not fully contract back onto the plug after the maximum diameter of the ball end passes beyond the seal point.

Maintenance of a seal has also been a problem at the journals and bearings associated with the pivoted valve. If the bearings provide a possible passage into the container, closing them off without excessive and complicated arrangements has proven to be difficult. The use of domeshaped journals and bearings to avoid apertures in the walls of the valve receptacle seemed to be a good idea, but did not provide a positive location for either the valve axis or the vent plug. The present invention appears to provide a solution to these problems.

SUMMARY OF THE INVENTION

The cover of the present invention provides a two-stage vent opening that dissociates the snap-in feature from the seal. A ball-ended plug first enters a forced fit opening on closure, and then enters a more relaxed and resilient section that gently grips the ball end to produce the seal. The sealing section is sufficiently displaced from the snap-in section to no longer be subject to distortion from repeated use of the snap-in function.

The journals and bearings of the valve have also been modified to allow a cylindrical configuration to provide the desirable positive location, and also a conical sealing action under resilient axial pressure applied in opposite directions along the valve axis.

DESCRIPTION OF THE PREFERRED EMBODIMENT

Figure 1:
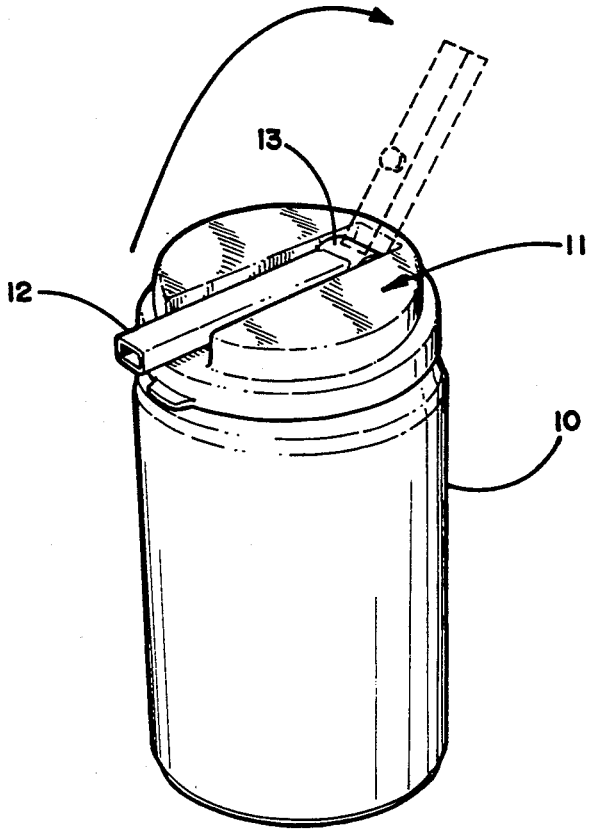
FIG. 1 is an exterior perspective elevation of a cover embodying the present invention installed on a standard beverage can, shown in the closed position.
Figure 2:
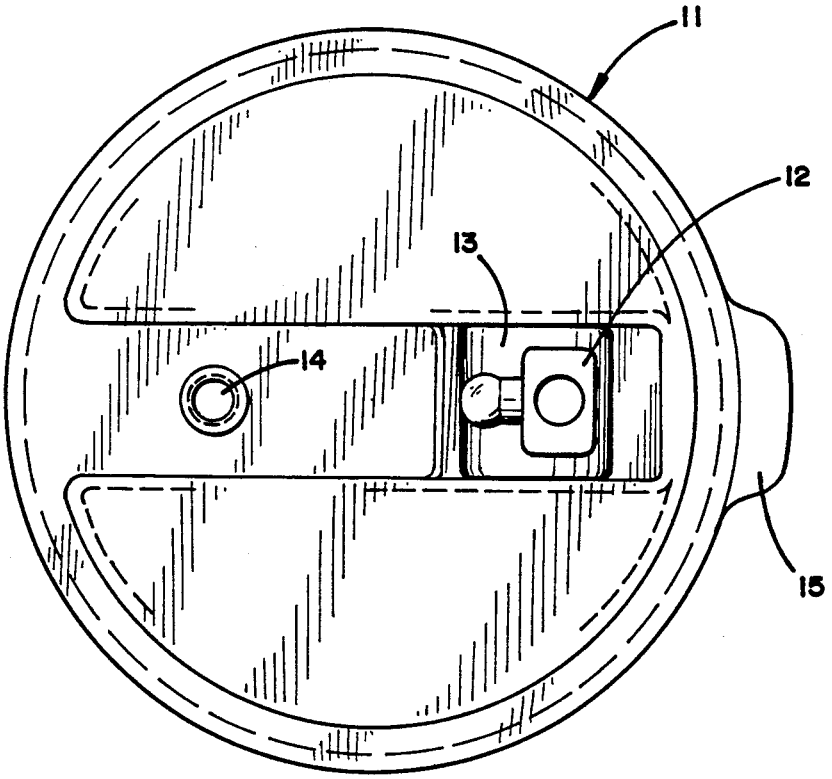
FIG. 2 is a top view of the cover assembly, in the open position of the spout.

Referring to FIG. 1, the standard beverage container 10 is shown equipped with the cover assembly 11. This is installed after the container 10 has been opened in the usual manner by establishing an opening in the top of the container. A withdrawal tube (not shown) is associated with the cover assembly 11, and is worked through the opening in the top of the container when the cover assembly is snapped on or screwed in place, depending upon the container configuration. The cover assembly 11 includes a tubular spout 12 which functions additionally as a lever to open and close a valve member 13 controlling the withdrawal passage. As the spout is swung from the full line position shown in FIG. 1 to the dotted line position, the valve is opened, and the vent passage 14 shown in FIG. 2 leading into the interior of the container is also opened. A tab 15 may be provided on one or opposite sides of the cover to facilitate removal of the device from the container.

Figure 3:
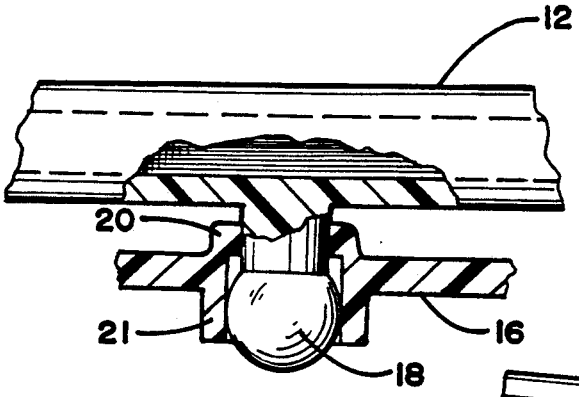
FIG. 3 is a fragmentary sectional elevation on an enlarged scale of a cover, shown in the closed position.
Figure 4:
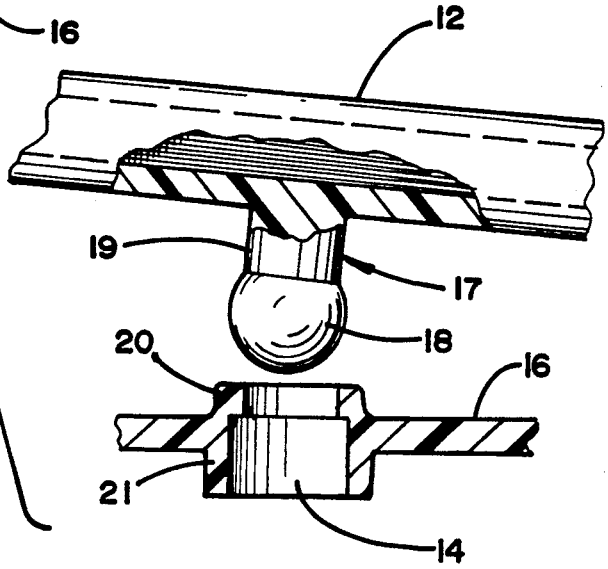
FIG. 4 is a view of the same structure shown in FIG. 3, with the ball end of the vent seal about to enter the vent opening.

Referring to FIGS. 3–4, the top panel 16 of the cover has a central configuration defining the vent opening 14. The spout 12 has a tangential plug 17 adapted to enter the vent opening 14, and has a ball-shaped end 18 and a stem 19 of reduced diameter. This configuration provides a considerable degree of flexibility to the plug 17 to accommodate accumulations of tolerance that may occur in the assembly. The vent opening 14 has a first portion 20 of sufficiently reduced diameter to provide a considerable amount of interference with the diameter of the ball end 18 to establish a snap-in function as the ball passes through the portion 20 of the vent passage. It should also be noted that the portion 20 is vertically displaced from the cover panel 16, so that the diameter distortion resulting from the snap-in function will not have to significantly expand the material of the cover 16. Once the ball end 18 has been forced through the portion 20 on closure of the spout 12 to the position shown in FIG. 3, the ball enters into the second passage section 21 of slightly larger diameter, which is still less than the diameter of the ball end 18. The section 21 is relatively thin-walled, and extends downward on the opposite side of the cover panel 16 from the first vent opening portion 20, which permits the tubular projecting portion 21 to function relatively independently as it grasps the ball end 18 after it has been forced through the snap-in portion 20. The repeated distentions of the portion 20 will therefor not effect the ability of the portion 21 to grip the ball end 18 sufficiently to establish the necessary seal. The amounts of the dimensional interference between the portions 20 and 21 and the ball end 18 will vary with the types of material selected for these components.

Figure 5:
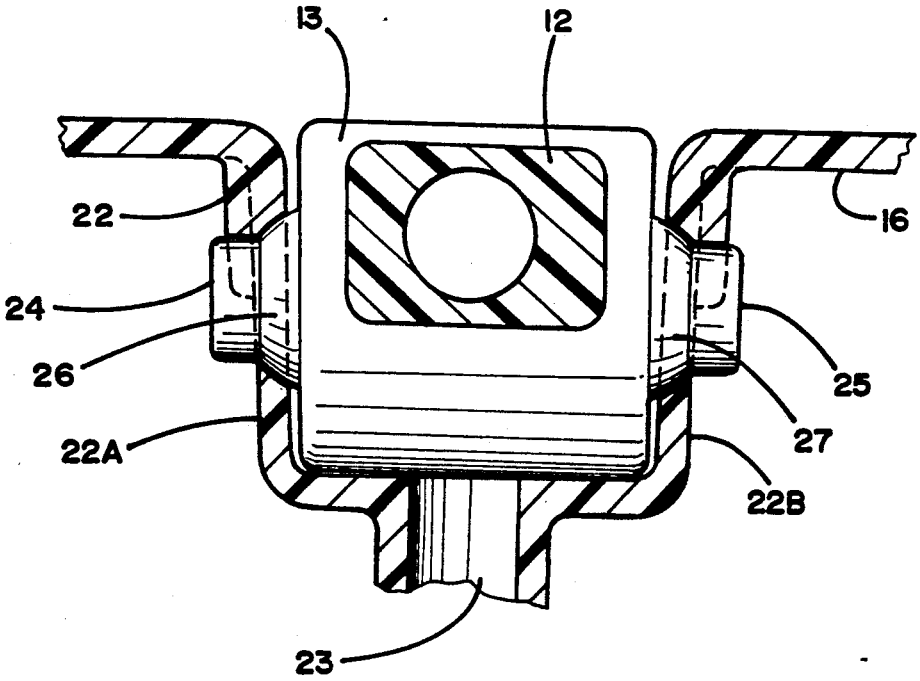
FIG. 5 is a section through the axis of the bearings and journals of the valve controlled by the spout position.

Referring to FIG. 5, a construction is illustrated for maintaining a seal at the pivot bearings and journals associated with the valve 13 and the spout-lever 12. The cover panel 16 has an integral portion defining the receptacle portion 22 receiving the rotatable valve member 13 controlling the withdrawal passage 23. The cylindrical journals 24 and 25 on the valve 13 are received in corresponding openings in the walls 22*a* and 22*b* defining opposite sides of the receptacle 22. Obviously, any degree of looseness at this point of interengagement would result in leakage of the pressure within the container. To avoid this, the journals are provided with conical tapered portions 26 and 27 which mate with corresponding conical surfaces in the walls 22*a* and 22*b* concentric with the bearing openings. This conical interengagement on opposite sides of the receptacle 22 is maintained under a resilient pressure from opposite axial forces resulting from the fact that the dimensions of the components require a very significant degree of distortion cf the receptacle 22 as the valve unit (with its journal sections) is forced into the assembled position shown in FIG. 5. This opposite combination of forces results in maintaining a sufficient pressure on the conical sections to establish the necessary seal. Here, again, the amount of the dimensional interference will vary according to the selection of the specific materials chosen for the components.

We claim:

1. A cover assembly for a beverage container, including a body portion adapted to form a cover for a standard container, said body portion having a passage disposed to communicate with the interior of said container, and having a receptacle communicating with said passage and including opposed bearing means, said assembly also including a pivoted valve member having journal means engaging said bearing means, and also having a valve portion received in said receptacle and adapted to open and close said passage, said valve member also having a tubular extension adapted to form a continuation of said passage in an open position of said valve member, said body portion also having a vent opening remote from said valve member, said tubular extension also having a ball-ended plug disposed to enter said vent opening in a closed position of said valve member, wherein the improvement comprises:

means on said body portion defining said vent opening with an axial sequence of diameters whereby one diameter receives said ball end in a tight forced fit to provide a snap-in function, and another diameter receives said ball end in a relatively light forced fit to establish a seal.

2. An assembly as defined in claim 1, wherein said one diameter is a first diameter engaged by said ball-ended plug on closure of said valve member to provide said snap-in function, and said other diameter is subsequently engaged on further closure of said valve member.

3. An assembly as defined in claim 1, wherein said body portion has a closure panel traversed by said vent opening, and said other diameter is defined by a tubular projection from said closure panel.

4. An assembly as defined in claim 3, wherein said tubular projection is below said panel.

* * * * *